US010499698B2

(12) United States Patent
Fildan et al.

(10) Patent No.: US 10,499,698 B2
(45) Date of Patent: Dec. 10, 2019

(54) ULTRA-SLIM FASTENER

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 0 days.

(21) Appl. No.: 15/825,441

(22) Filed: Nov. 29, 2017

(65) Prior Publication Data

US 2018/0077984 A1 Mar. 22, 2018

Related U.S. Application Data

(63) Continuation-in-part of application No. 15/350,567, filed on Nov. 14, 2016, now abandoned.

(30) Foreign Application Priority Data

Nov. 13, 2015 (GB) ..... 1520071.0

(51) Int. Cl.
*A41F 1/00* (2006.01)
*A44B 13/00* (2006.01)

(52) U.S. Cl.
CPC ..... *A41F 1/006* (2013.01); *A44B 13/0023* (2013.01); *A44B 13/0047* (2013.01)

(58) Field of Classification Search
CPC .. A41F 1/006; A44B 13/0023; A44B 13/0047
See application file for complete search history.

(56) References Cited

U.S. PATENT DOCUMENTS 1,854,125 A * 4/1932 Faber ..... A41F 15/002 24/578.15
3,484,907 A * 12/1969 Elsenheimer ..... A41F 1/006 24/588.12
3,837,049 A * 9/1974 Corrado ..... A41F 1/006 24/578.1

(Continued)

FOREIGN PATENT DOCUMENTS

| | | |
|---|---|---|
| EP | 0084747 A1 | 8/1983 |
| FR | 1409820 | 9/1965 |
| JP | S547701 U | 1/1979 |

*Primary Examiner* — Robert Sandy
*Assistant Examiner* — David M Upchurch
(74) *Attorney, Agent, or Firm* — Kintner IP, LLC; Mary Frances Ludwig

(57) ABSTRACT

An ultra-slim fastener for a bra includes male and female parts mounted on fabric pieces. The male part has a planar body having a downwardly depending leg terminating in an outwardly projecting foot extending parallel to the body. The female part has a substantially planar frame defining a cavity for reception of the foot. The cavity is roofed in towards the innermost end of the frame only, thereby defining an open mouth towards the outermost frame end. In embodiments, a fabric strip forms a backing for the frame and the bottom of the cavity is closed off. The second piece further includes an overlay mounted partially above the frame and on the fabric strip, sandwiching the frame between the overlay and the fabric strip. Embodiments are provided for use with reversible garments. Such a fastener will be very thin yet very strong.

17 Claims, 9 Drawing Sheets

(56) References Cited

U.S. PATENT DOCUMENTS

| | | | | |
|---|---|---|---|---|
| 4,183,121 | A * | 1/1980 | Cousins | A44B 13/0023 24/588.1 |
| 4,204,300 | A * | 5/1980 | Fildan | A44B 11/2584 24/578.1 |
| 6,309,489 | B1 * | 10/2001 | Fildan | A41F 1/006 156/201 |
| 6,536,085 | B1 * | 3/2003 | Milano | A41F 1/006 24/580.1 |
| 6,557,232 | B2 * | 5/2003 | Fildan | A41F 1/006 24/114.6 |
| 6,793,556 | B1 * | 9/2004 | Fildan | A41C 3/02 2/323 |
| 7,707,698 | B2 * | 5/2010 | Gardner | A41F 1/006 2/265 |
| 8,302,269 | B2 * | 11/2012 | Pitman | A41F 1/006 24/591.1 |
| 2005/0251970 | A1 * | 11/2005 | Fildan | A41F 1/006 24/114.05 |
| 2017/0135429 | A1 | 5/2017 | Fildan et al. | |

* cited by examiner

ULTRA-SLIM FASTENER

CROSS REFERENCE TO RELATED APPLICATION

This application is a Continuation-In-Part of and claims the filing benefit under 35 U.S.C. § 120 of application Ser. No. 15/350,567, filed on 14 Nov. 2016, and claims a right of priority under 35 U.S.C. § 119 from United Kingdom patent application 1520071.0, filed on 13 Nov. 2015, and claimed in U.S. application Ser. No. 15/350,567, both of which previously filed applications are hereby incorporated by reference.

TECHNICAL FIELD

This invention relates to an ultra-slim fastener and a method of manufacturing same. In particular, the invention relates to an ultra-slim fastener for use in the manufacture of an article of clothing such as a brassiere.

BACKGROUND OF THE INVENTION

There are many disparate types of fasteners used in the manufacture of articles of clothing. The type of fastener chosen for a given application will depend in part on the intended application, as often different design considerations apply to different applications. For example, fasteners for a brassiere (hereinafter referred to simply as a "bra") will preferably be low profile fasteners, will ideally be relatively simple for the wearer to open and close, and yet will be sufficiently secure so that they are not prone to inadvertent opening during normal movement of the wearer. These are all important considerations when designing a fastener for a bra.

By having a low profile, the fastener will protrude less through the wearer's clothing and will provide a more aesthetically pleasing offering. Furthermore, by having a low profile the fasteners will have less tendency to catch on other items of clothing. It is important that bra fasteners in particular are simple for the wearer to open and close. Often, the closures will be behind the wearer's back and a fastener that is relatively simple to open and close will facilitate dressing and undressing. This is particularly important if the wearer has arthritis or another condition that may affect their manual dexterity.

It is also important that, as well as being relatively simple to open and close deliberately, the fastener must not be prone to inadvertent opening. A fastener that opens inadvertently may cause considerable embarrassment to the wearer as well as inconvenience. For example, if the fastener is part of a bikini or bra, inadvertent opening of the fastener may result in the wearer exposing themselves to others which may be a cause of great distress. Similarly, if the fastener opens unintentionally with regularity, this can be most inconvenient as the wearer will have to resecure the fastener each time it opens. This may require the wearer to leave their current location and go to a place with more privacy, such as a bathroom, so that they can resecure the fastener.

However, often, the different design considerations conflict with each other. For example, as a general rule of thumb, the thinner that a fastener becomes, the more prone it will be to opening inadvertently. This is particularly the case for fasteners constructed from plastic material. When the fastener constructed from plastic material is made very thin, it will lose much of its structural rigidity and will have a tendency to bend and therefore open inadvertently under an applied load.

A number of fasteners are known in the art. European Pat. App. No. EP0084747 in the name of Tareau describes a fastener for a garment. U.S. Pat. No. 6,536,085 in the name of Milano describes an adjustable fastener for clothing, including brassieres. U.S. Pat. No. 6,309,489 in the name of Fildan et al discloses an adjustable strap fastener for brassieres and a method of making same. French Pat. App. No. FR1409820 in the name of Girodet describes a fastener for a brassiere or other article of lingerie. Japanese Pat. App. No. JPS547701U also appears to disclose a fastener.

It is an object of the present invention to provide a fastener that overcomes at least some of the problems with the known fasteners. It is a further object of the invention to provide a fastener that offers a useful alternative choice to the consumer.

BRIEF SUMMARY OF THE INVENTION

According to the invention there is provided an ultra-slim fastener for securing two pieces together, the fastener comprising:

a male part mounted on the first piece and a female part mounted on the second piece;

the male part comprising a substantially planar body having at its outermost body end a downwardly depending leg terminating in an outwardly projecting foot extending substantially parallel to the plane of the body;

the female part comprising a substantially planar frame defining a cavity for reception and retention of the foot, the cavity being partially roofed in towards the innermost frame end thereby defining an open mouth towards the outermost frame end;

the foot, cavity, and the open mouth being dimensioned so that insertion of the foot into the cavity must be realized by inclining the body of the male part relative to the frame of the female part before bringing the male part and the female part together, retention of the foot in the cavity is realized by pivoting the inserted male part from the inclined orientation to a co-planar orientation with respect to the female part using the roof of the cavity as a fulcrum, and release of the foot from the cavity is realized by pivoting the inserted male part from the co-planar orientation back to the inclined orientation using the roof of the cavity as a fulcrum before moving the male part and the female part apart;

and in which the second piece comprises a fabric strip and an overlay, at least one of the fabric strip and the overlay has an aperture, and the frame of the female part is mounted to the second piece such that the frame is sandwiched between the fabric strip and the overlay, and the aperture corresponds with the open mouth.

In another embodiment, the frame of the female part is mounted to the second piece so that the fabric strip forms a backing for the frame and the bottom of the cavity is closed off by the fabric strip.

By having such a fastener, the fastener can be made ultra-slim, less than 4 mm in depth from top to bottom, while maintaining greater structural integrity and the ability to resist inadvertent opening under an applied load. Typically, fasteners of this type would be unsuitable for applications with loads over a few kilograms, thereby significantly limiting their use. However, by mounting the female part's frame directly onto the face of the fabric strip so that the fabric strip forms a backing for the frame and providing an overlay on top of the frame in the manner described, the frame will have significantly greater structural integrity and resistance to bending under tensile strain. This allows for a thinner fastener to be used. The fastener according to the invention will have a tensile strength rating of up to 12 kgs which far exceeds the amount for fasteners of this type and will not be inclined to open inadvertently.

Furthermore, the fabric strip backing will provide greater resistance to the pivoting motion required for release of the male part and have a tendency to keep the male part and the female part in a substantially planar, locked configuration. This will further obviate the possibility of the fastener releasing inadvertently under normal movement by the wearer.

In one embodiment, an ultra-slim fastener has a frame of the female part which is bonded to the second piece. Bonding is seen as a particularly useful way of connecting the female part to the second piece as this will facilitate the provision of an ultra-slim fastener.

In one embodiment of an ultra-slim fastener the frame of the female part is ultrasonically welded to the second piece. Ultrasonic welding is seen as an ideal way to bond the fabric to the plastic that will obviate the need for adhesives and the difficulties inherent with the use of adhesive while allowing a very low profile device to be produced.

In one embodiment of the ultra-slim fastener the second piece comprises a laminate of tricot fabric and microfiber fabric. The tricot fabric is particularly useful as it will provide a good bond with the plastic material of the female part. Furthermore, both the tricot and the microfiber fabric will be sufficiently resilient that they will allow the male part to be pivoted from a planar configuration to an inclined configuration when desired.

In one embodiment of the ultra-slim fastener, the frame comprises an upstanding collar surrounding the open mouth. By having an upstanding collar surrounding the mouth, the upstanding collar will protect the fabric overlay from any sharp edges and the likelihood of the overlay being damaged are significantly reduced.

In one embodiment of the ultra-slim fastener, part of the upstanding collar on the side of the open mouth adjacent the innermost end of the frame extends further upwardly from the frame than the remainder of the upstanding collar. This is seen as useful as this part of the upstanding collar will act as a backstop for the toe of the male part's foot and will facilitate the closure of the fastener.

In one embodiment of the ultra-slim fastener, the frame comprises a first downwardly depending flange on the side of the cavity adjacent the outermost frame end. The first downwardly depending flange provides greater rigidity to the frame and will enable the frame to withstand greater forces than would otherwise be the case.

In one embodiment of the ultra-slim fastener, the frame comprises a second downwardly depending flange, the second downwardly depending flange being positioned on the side of the cavity adjacent the innermost frame end and being dimensioned to protrude downwardly from the frame by the same distance as the other flange. The second downwardly depending flange is useful in that it will keep the fabric strip backing of the second piece spaced evenly across the rear of the frame and the frame will sit flat across the wearer's back. This in turn will help to ensure that the fastener remains closed and assumes a flatter appearance across the wearer's back.

In one embodiment of the ultra-slim fastener, the side wall of the cavity adjacent the outermost frame end slopes towards the outermost frame end from top to bottom. By having the side wall of the cavity sloping in this fashion, the fastener will be able to withstand greater tensile strain than would otherwise be the case. As the male part and female part are subjected to tensile strain, the heel of the foot portion of the male part will be forced against this side wall of the cavity. By having the side wall sloped in this manner, the heel and by extension the male part will be drawn further inwardly into the cavity under this force, thereby further securing the fastener.

In one embodiment of the ultra-slim fastener, the side wall of the cavity adjacent the innermost frame end slopes towards the innermost end from top to bottom.

In one embodiment of the ultra-slim fastener, the first piece comprises a fabric strip.

In one embodiment of the ultra-slim fastener, the fabric strip of the first piece comprises tricot fabric.

In one embodiment of the ultra-slim fastener, the fabric strip of the first piece comprises microfiber fabric.

In one embodiment of the ultra-slim fastener, the body of the male part is bonded to the first piece.

In one embodiment of the ultra-slim fastener, the body of the male part is ultrasonic welded to the first piece.

In one embodiment of the ultra-slim fastener, the first piece comprises an upper component mounted on the top of the body and a lower component mounted on the bottom of the body, the body being sandwiched between the upper and the lower components. By having both upper and lower components, the male part will have less tendency to twist under load and furthermore a secure connection between the plastic body and the fabric first piece will be provided.

In one embodiment of the ultra-slim fastener, the upper component and the lower component both extend beyond the innermost end of the planar body thereby forming a flap that extends beyond the innermost end of the planar body. This flap will facilitate the connection of the end of the male part of the fastener onto another part of a garment such as the rearward arm of a bikini or a bra.

In one embodiment of the ultra-slim fastener, the upper component and the lower component are connected together beyond the innermost end of the planar body.

In one embodiment of the ultra-slim fastener, the foot has a heel portion that slopes away from the outermost end from top to bottom. As with the sloped wall of the cavity outlined above, by having the heel portion sloping away from the outermost end from top to bottom, the heel will be urged further into the cavity of the female part under load, thereby improving the engagement therebetween.

In one embodiment of the ultra-slim fastener, the foot has a toe portion that slopes away from the outermost end from top to bottom.

In one embodiment of the ultra-slim fastener, the substantially planar body has at its outermost end an upwardly extending flange. As with the collar of the female part's frame, the upwardly extending flange will help to locate the male part in the female part and will also act as an end stop to prevent the male part being forced into the female part too far.

In one embodiment of the ultra-slim fastener, the depth of the male part from the uppermost point on the male part to the lowermost point of the foot is no more than 0.0027 m deep. This is seen as preferred to provide an ultra-slim fastener.

In one embodiment of the ultra-slim fastener, the depth of the female part from the uppermost point on the frame to the lowermost point of the second piece connected to the frame is no more than 0.0034 m deep. This is also seen as preferred to provide an ultra-slim fastener.

In one embodiment of the ultra-slim fastener, the depth of the fastener from the uppermost point on the male part to the lowermost point of the second piece connected to the female part's frame when the male and female parts are engaged is no more than 0.0035 m deep. By having a fastener of this depth, the fastener will have many beneficial applications from bras, swimwear, sportsbras as well as other items of clothing that would benefit from an ultra-slim fastener of this type.

In one embodiment of the ultra-slim fastener, the cavity and the foot are substantially rectangular shaped.

In one embodiment of the ultra-slim fastener, the foot of the male part has a lateral width which decreases outwardly from a region near the leg to the toe portion of the foot. In another embodiment, the foot has sides extending outwardly from the leg to the toe portion. The sides of the foot may be rounded, angled inwardly, or curved inwardly. These features promote easy opening and closing of the fastener, as the male part may be more readily inserted into or removed the female mouth. The reduction in width of the toe portion permits coupling with a slight initial misalignment of the toe with the mouth, the correct alignment being guided upon initial insertion by the side of the foot. When decoupling, the deceasing width or shape of the sides of the foot permits a degree of twisting to simplify removal of the male from the female.

In one embodiment of the ultra-slim fastener, the body of the male part includes two longitudinal channels positioned on opposing sides of the foot. These channels, having a decreased thickness relative to the rest of the male body, provide resiliently flexible regions adjacent both sides of the foot. The additional flexibility eases coupling and decoupling of the male from the female, and provides additional comfort to the wearer.

In one embodiment of the ultra-slim fastener, the female part comprises a plurality of frames arranged in a row, each of the frames defining a cavity for reception and retention of the foot, the cavities being partially roofed in towards the innermost end of the frame thereby each defining an open mouth towards the outermost end of the frame. This is seen as particularly useful as a plurality of frames arranged in a row will provide for easy adjustment of the bra to suit different torso dimensions of the wearer.

In one embodiment of the ultra-slim fastener, a plurality of female parts are arranged in a longitudinally spaced row, alternately mounted to the fabric strip and the overlay of the second piece. The female parts are positioned so that mouths of each female part alternately open forwardly and rearwardly. The leg of the male part depends both upwardly and downwardly from the body, and terminates in two legs opposed about the body. This embodiment provides a reversible fastener, where one of the male legs may be coupled to any of the forwardly facing female mouths and, when worn in reverse, the other of the male legs may be coupled to any of the rearwardly facing female mouths.

In one embodiment of the ultra-slim fastener, the second piece includes a pair female parts, one of the female parts mounted to the fabric strip and the other of the female parts mounted to the overlay. The female parts are positioned so that the cavities of each are aligned longitudinally, and the mouth of one female part opens forwardly while the mouth of the other female part opens rearwardly. The leg of the male part depends both upwardly and downwardly from the body, and terminates in two legs opposed about the body. These features provide another embodiment of a reversible fastener, where the male legs may be coupled forwardly or rearwardly as described above. This embodiment provides a high degree of adjustability when worn from either side.

In one embodiment there is provided a method of manufacturing an ultra-slim fastener of the type according to the preceding embodiments, the method comprising the steps of:

cutting out an aperture in at least one of a fabric strip or an overlay sheet;

bonding the overlay sheet to the fabric strip along at least one edge of both the overlay sheet and the fabric strip;

placing the frame of the female part on one of the fabric strip or the overlay sheet with the open mouth of the frame in alignment with the aperture;

bonding the frame of the female part to one of the fabric strip or the overlay sheet;

drawing the fabric strip over the other side of the frame of the female part so that the bond line along the bonded edge of both the overlay sheet and the fabric strip is sandwiched between the overlay sheet and the fabric strip; and, bonding the fabric strip to the other side of the frame and bonding the overlay sheet to the fabric strip along any remaining un-bonded edges.

This is seen as a particularly effective way to manufacture the ultra-slim fastener. By having the bond line internally located like this, a fastener with a smooth exterior will be provided which will not have a tendency to irritate the skin of the wearer. The fastener will therefore be comfortable for the wearer to have in contact with their skin and will also will require less trimming of the fabric.

In one embodiment there is provided a method of manufacturing an ultra-slim fastener in which the initial step of bonding the overlay sheet to the fabric strip along at least one edge of both the overlay sheet and the fabric strip comprises bonding the overlay sheet to the fabric strip along three edges of the overlay sheet and the fabric strip thereby forming a pouch, and in which the step of drawing the fabric strip over the other side of the frame of the female part so that the bond line along the bonded edge is sandwiched between the overlay sheet and the fabric strip comprises turning the pouch inside out, thereby drawing the frame inside the pouch. This is seen as a particularly preferred method of manufacturing the fastener that will keep most of the bond lines inside the finished fastener. This will result in a fastener that is both comfortable to wear and efficient to manufacture as less trimming will be required and less waste will have to be disposed of.

In one embodiment there is provided a method of manufacturing an ultra-slim fastener in which the overlay sheet is bonded to the fabric strip along one edge but spaced apart from the edge, thereby forming a flap. This will enable the flap to be used in the subsequent attachment of the female part to a garment.

In one embodiment there is provided a method of manufacturing an ultra-slim fastener in which the method comprises the subsequent steps of:

allowing the overlay sheet and the fabric strip to cool; and, trimming the overlay sheet and the fabric strip once they have cooled.

In one embodiment there is provided a method of manufacturing an ultra-slim fastener in which the steps of bonding the frame, the overlay strip and the fabric sheet comprise ultrasonic bonding the frame, the overlay strip and the fabric sheet. Ultrasonic welding of the second piece to the frame of the female part is seen as ideal as this will provide a very low profile device while maintaining a strong bond between the two components. This is also seen as cost effective and efficient for the manufacturing process and obviates the needs for adhesives and the inherent difficulties working with adhesives.

In one embodiment the method comprises the step of bonding the body of the male part to the first piece.

In one embodiment of the a method the step of bonding the body of the male part to the first piece comprises ultrasonic bonding the body of the male part to the first piece.

In one embodiment the method comprises the steps of: folding the first piece back on itself intermediate its ends; bonding one end of the first piece to one side of the body of the male part; and, bonding the other end of the first piece to the other side of the body of the male part.

In one embodiment there is provided a method of manufacturing an ultra-slim fastener in which the first piece comprises two separate strips of fabric and the method comprises the steps of: bonding one of the strips of fabric to one side of the body of the male part; and bonding the other of the strips of fabric to the other side of the body of the male part.

In one embodiment the method comprises the initial step of bonding a layer of tricot fabric to a layer of microfiber fabric.

Other embodiments, in addition to the embodiments enumerated above, will become apparent from the following detailed description, taken in conjunction with the accompanying drawings, which illustrate, by way of example, the principles of the fastener and method of manufacturing same.

DETAILED DESCRIPTION OF THE INVENTION

Figure 1:
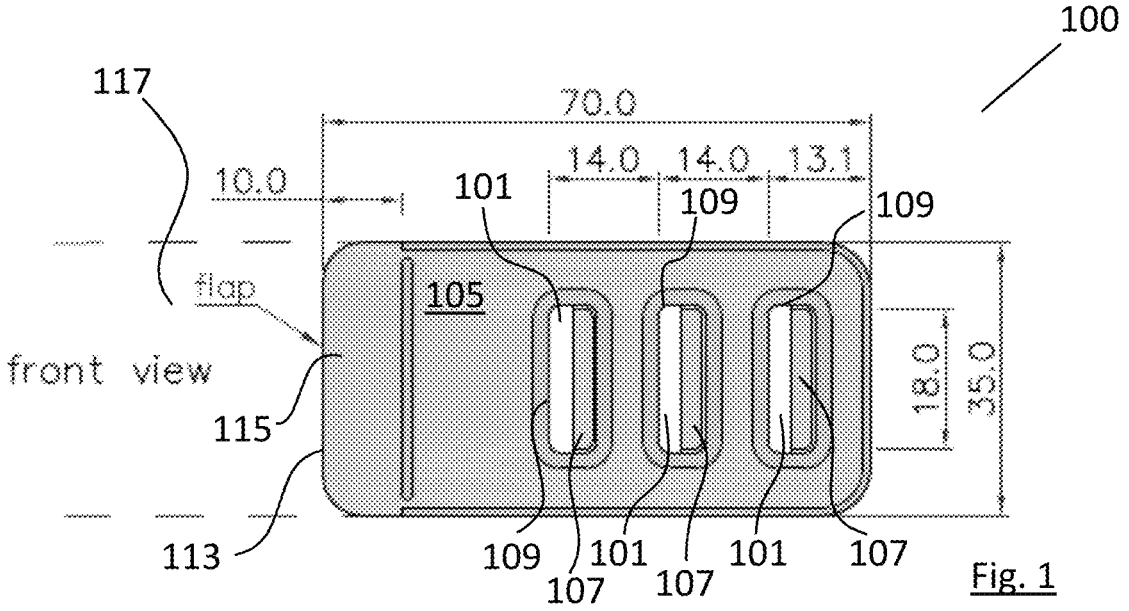
FIG. 1 is a front view of a female part of a fastener.
Figure 2:
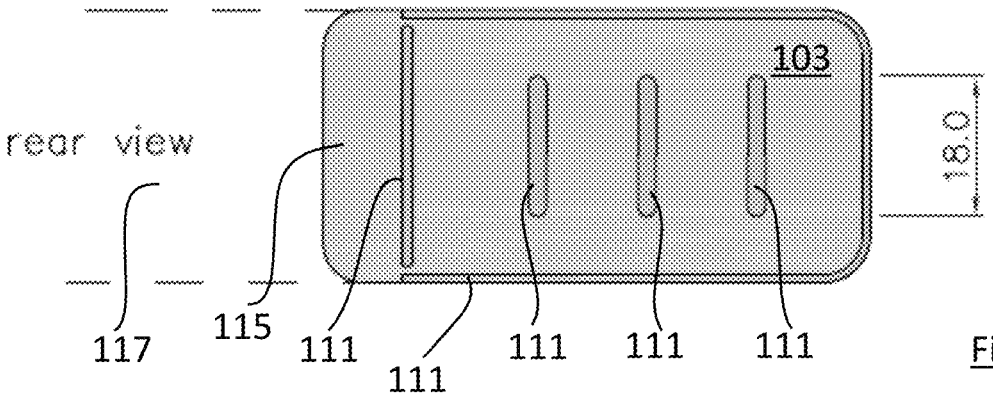
FIG. 2 is a rear view of the female part of FIG. 1.

Referring to FIGS. 1 & 2, there is shown a female part of the fastener, indicated generally by the reference numeral 100, comprising a substantially planar frame 101 mounted directly onto the face of a fabric strip 103. There is further provided an overlay 105 mounted onto the top of the frame and onto the face of the fabric strip 103, sandwiching the frame 101 between the overlay 105 and the fabric strip 103. The frame 101 has a cavity (as will be shown in greater detail with reference to FIG. 9 below) partially roofed in, thereby defining an open mouth 107. The overlay 105 comprises an aperture 109 corresponding with the frame's open mouth. A plurality of weld lines 111 illustrate the areas where at least two of the frame, the overlay, and the fabric strip have been joined together. One of the weld lines 111 is spaced apart from the innermost end 113 of the female part thereby forming a flap 115 that may be used to connect the female part to a portion of a garment 117 (shown in dashed outline).

Figure 3:
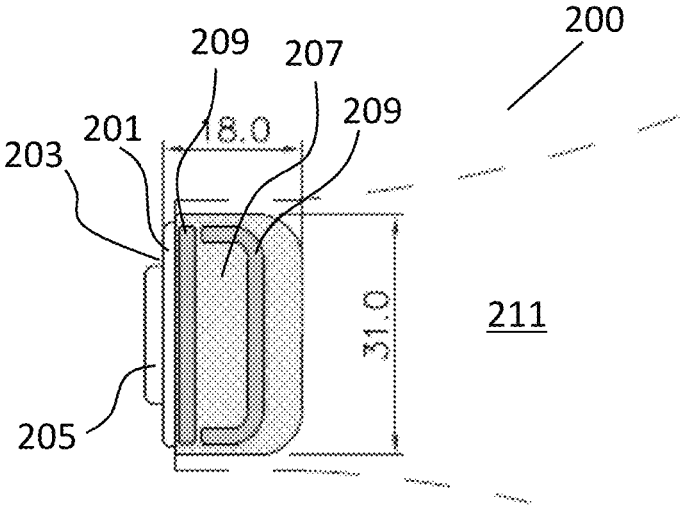
FIG. 3 is a front view of a male part of the fastener.
Figure 4:
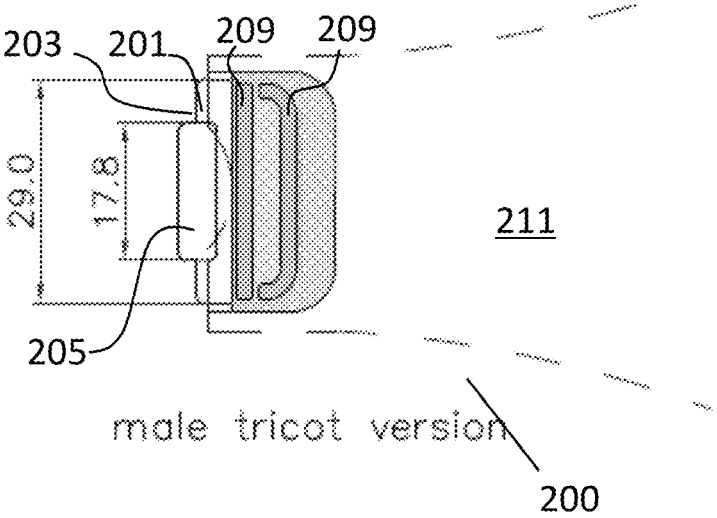
FIG. 4 is a rear view of the male part of FIG. 3.

Referring to FIGS. 3 & 4, there is shown a first embodiment of a male part of the fastener, indicated generally by the reference numeral 200. The male part comprises a substantially planar body 201 having at its outermost body end 203 a downwardly depending leg (see below discussion of FIG. 7) terminating in an outwardly projecting foot 205. The outwardly projecting foot extends substantially parallel to the plane of the body 201. The substantially planar body 201 is connected to a first piece 207, in this case a piece of tricot fabric, by weld joints 209. The first piece 207 may then be used to connect the male part to a portion of a garment 211 (shown in dashed outline).

Figure 7:
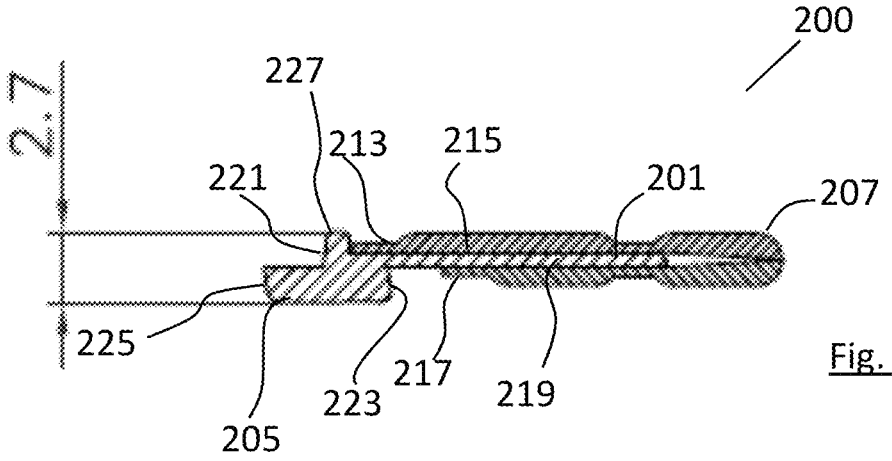
FIG. 7 is a side cross-sectional view of the male part of FIGS. 3 & 4.

Referring to FIG. 7, there is shown an enlarged, side cross-sectional view of the male part 200 of the fastener. It can be seen that an upper component 213 of the tricot fabric first piece 207 is bonded to an upper side 215 of the body 201. The first piece 207 is then turned back on itself, and a lower component 217 of the first piece 207 is then bonded to a lower side 219 of the body 201. Importantly, it can be seen from FIG. 7 that the male part comprises a downwardly depending leg 221 at the outermost body end 203 which terminates in an outwardly projecting foot 205 extending substantially parallel to the plane of the body. The outwardly projecting foot 205 comprises a heel portion 223 and a toe portion 225. The heel portion 223 is inclined rearwardly top to bottom from the outermost end of the male part 200. Finally, there is provided an upwardly extending flange 227 protruding from the upper surface of the substantially planar body coincident with the downwardly depending leg 221.

Figure 5:
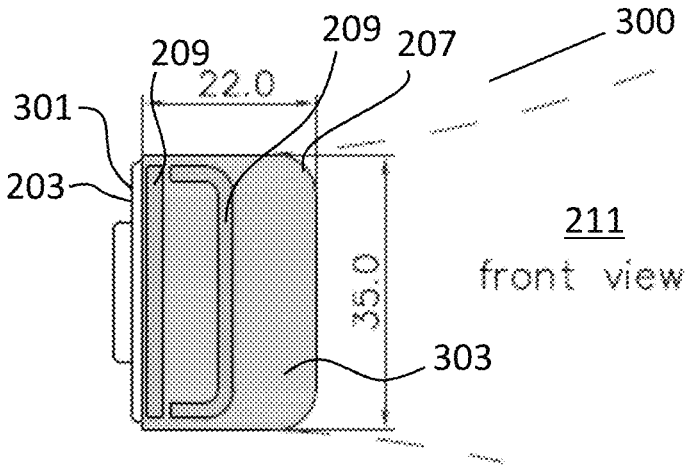
FIG. 5 is a front view of an alternative embodiment of a male part of the fastener.
Figure 6:
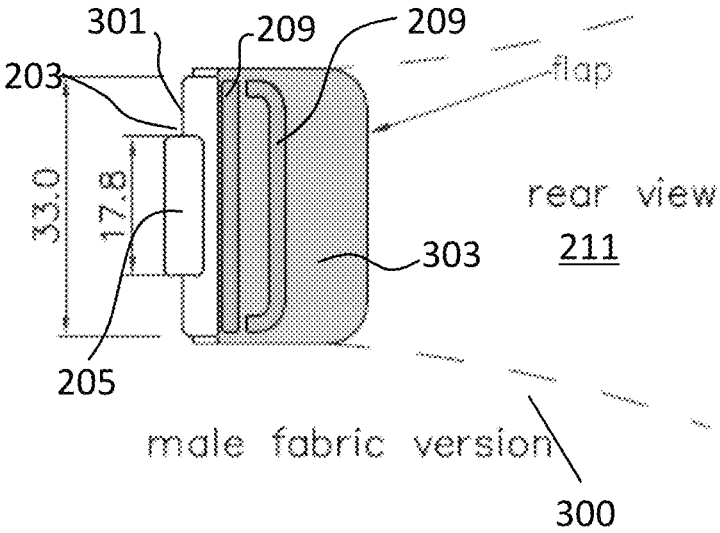
FIG. 6 is a rear view of the male part of FIG. 5.
Figure 8:
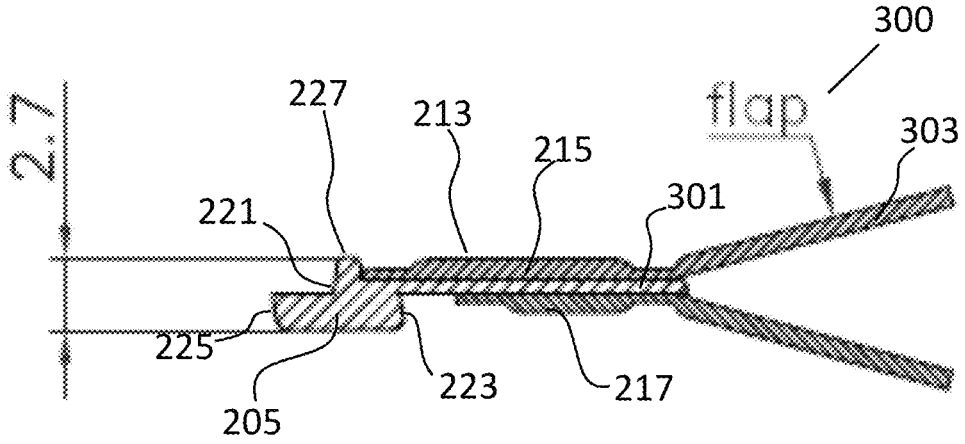
FIG. 8 is a side cross-sectional view of the male part of FIGS. 5 & 6.

Referring now to FIGS. 5, 6, & 8, there is shown a second embodiment of a male part of the fastener, indicated generally by the reference numeral 300, where like parts have been given the same reference numerals as before. The male part 300 differs from the male part 200 in that the substantially planar body 301 is slightly greater in lateral width than the planar body of the embodiment shown in FIGS. 3, 4, & 7. Furthermore, instead of having a first piece 207 made from a tricot fabric, the first piece 207 in this instance is constructed from a microfiber fabric. In addition to the foregoing, the upper component 213 of the first piece 207 is separate from the lower component 217 of the first piece 207 and the upper and lower components 213 & 217 extend further from the end of the substantially planar body 301 thereby forming a flap 303 that may be used for connection of the male part to a garment 211.

Figure 9:
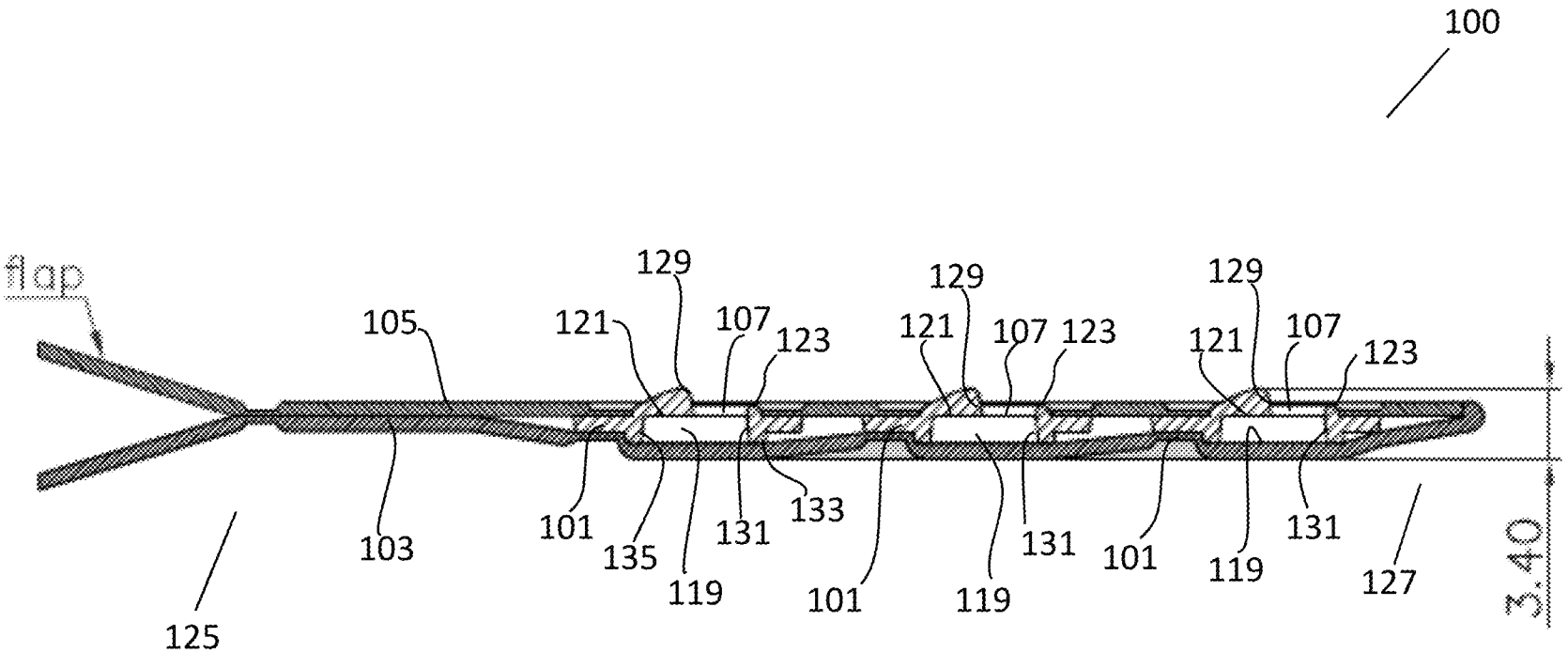
FIG. 9 is an enlarged side cross-sectional view of the female part.

Referring now to FIG. 9, there is shown an enlarged, side cross-sectional view of a female part of the fastener according to the invention, indicated generally by the reference numeral 100. As outlined above in relation to FIGS. 1 & 2, the female part 100 of the fastener comprises a substantially planar frame 101 mounted directly onto the face of a fabric strip 103. There is further provided an overlay 105 mounted onto the top of the frame 101 and onto the face of the fabric strip 103, sandwiching the frame 101 between the overlay 105 and the fabric strip 103. In the embodiment shown, there are three frames mounted in a row. This is not intended to be limiting and more or fewer frames may be provided depending on the degree of adjustability required.

Each of the frames 101 further comprises a cavity 119 for reception of a foot of a male part. The cavity 119 is partially roofed in by roof 121 and there is defined an open mouth 107 for permitting access to the cavity 119. A circumferential upstanding collar 123 is provided which surrounds the open mouth 107 and protrudes upwardly therefrom. This collar protects the fabric overlay placed over the frame and the fabric strip. The collar 123 protrudes upwardly further towards the inner end 125 of the female part than it does towards the outer end 127 of the female part. An enlarged portion 129 of the collar nearest the inner end of the female part acts as a backstop for the male part when the male part 200 or 300 is being joined together with the female part 100. The cavity side wall 131 positioned closer to the outer end 127 of the female part is angled from top to bottom towards the outer end 127. This will facilitate engagement of the male and female parts once the male and female parts come under tension.

It can be seen that the frame comprises a first downwardly depending flange 133 on the side of the cavity adjacent the outermost end of the female part and the frame 101 comprises a second downwardly depending flange 135 positioned on the side of the cavity adjacent the innermost end of the frame 101. The flange 133 provides additional structural rigidity to the frame 101 and the flange 135 is dimensioned to protrude downwardly from the frame by the same distance as the flange 133 so that the frame 101 may be kept level with respect to the fabric strip 103. It can be seen that the fabric strip 103 provides a backing for the frame 101 and the bottom of the cavity 119 is closed off by the fabric strip.

Figure 10:
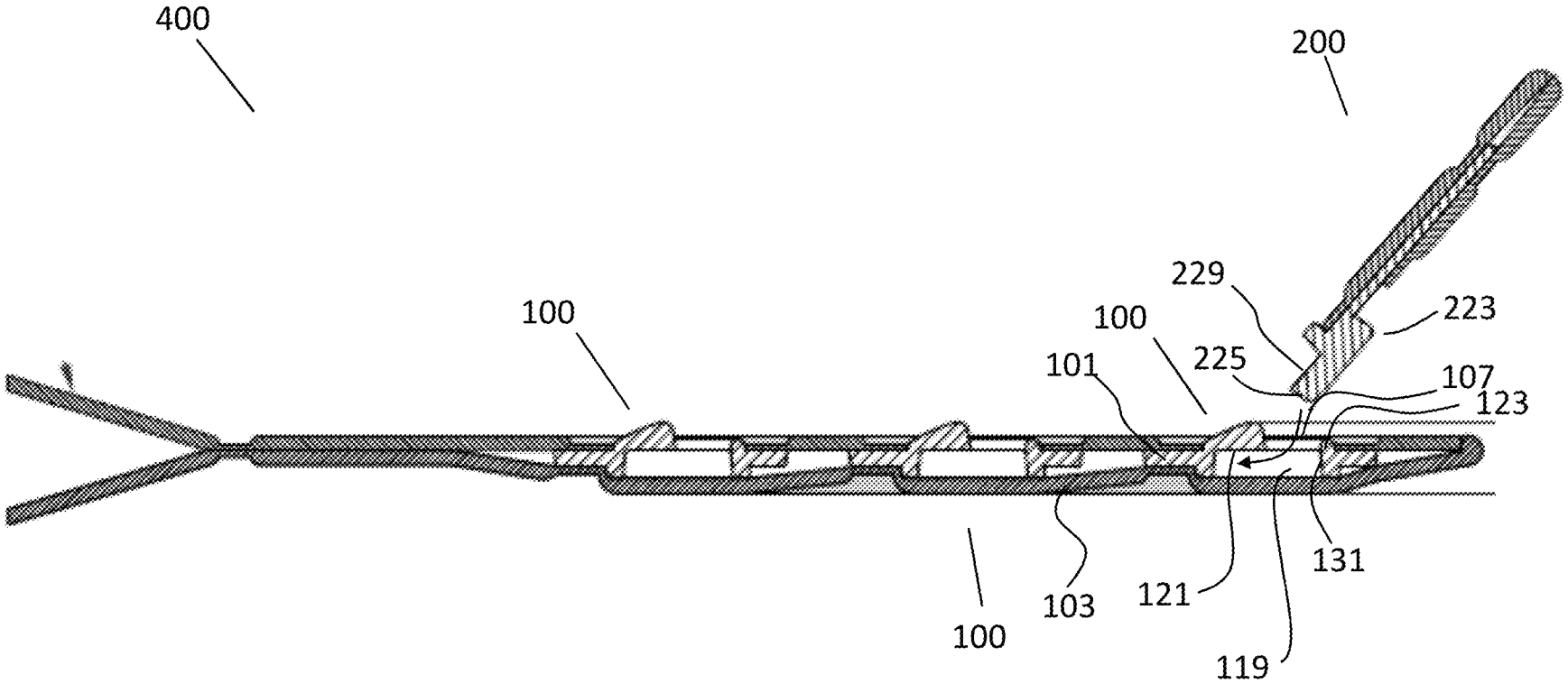
FIG. 10 is a side cross-sectional view showing the male part being brought into engagement with the female part.

Referring to FIG. 10, there is shown a fastener, indicated generally by the reference numeral 400. The view is similar to that shown in FIG. 9 but with a male member 200 about to be inserted into the frame 101 of the female member 100. It can be seen that the male member is inclined at an angle to the horizontal so that it can be inserted into the cavity 119 through the open mouth 107 of the cavity. The toe portion 225 is inserted first into the open mouth and when a bridge 229 of the foot portion engages with the roof 121 of the cavity, the foot will be pivoted in a clockwise direction using the roof 121 as a fulcrum. The heel 223 will abut against the collar 123 and the collar or the heel will be sufficiently resiliently deformable to allow the heel to snap in place beyond the collar so that the foot is lying substantially horizontal in the cavity. In other words, the male and female parts will be substantially in line with each other rather than being in the inclined position. Once in position, the fastener will resist inadvertent release, as the foot will be engaged in the cavity and the foot (and in particular the heel portion 223 and bridge portion 229) together with the cavity side wall 131, the collar 123, and the roof 121 will act to hold the foot in the cavity and the male part 200 and female part 100 together. Furthermore, the fabric strip 103 will also act to prevent inadvertent dislodgement of the male part from the female part as it will act against a pivoting motion of the male part from a parallel configuration to an inclined configuration. It will also act to press the bridge portion 229 of the male part against the roof 121 which helps to maintain the parts together.

Figure 11:
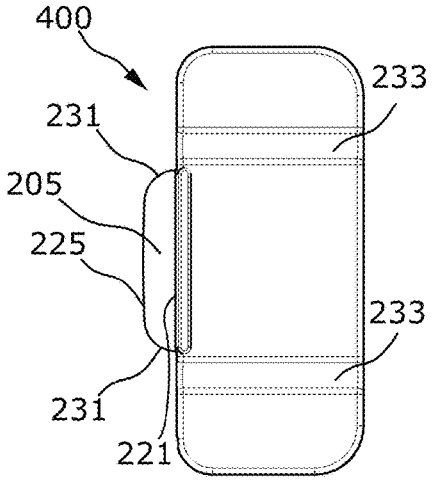
FIG. 11 is a front view of another embodiment of the male part.
Figure 12:
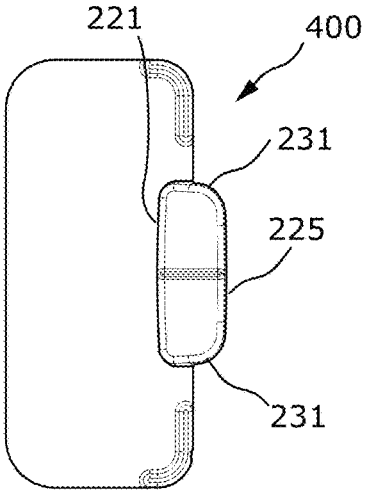
FIG. 12 is a rear view of the male part of FIG. 11.

FIGS. 11 & 12 show front and rear views, respectively, of another embodiment of the male part, indicated generally by the reference numeral 400, where like parts have been given the same reference numerals as before. In embodiments 200 & 300 of FIGS. 3-6, foot 205 has a substantially rectangular shape. In male part 400, foot 205 has a lateral width which decreases outwardly from a wider width near the leg 221 to a narrower width at toe portion 225. The reduced width of toe portion 225 simplifies alignment and insertion of the toe portion into mouth 107 of the female part. Toe portion 225 of male part 400 has sides 231 which are rounded or outwardly curved from the narrower to wider width regions.

Figure 13:
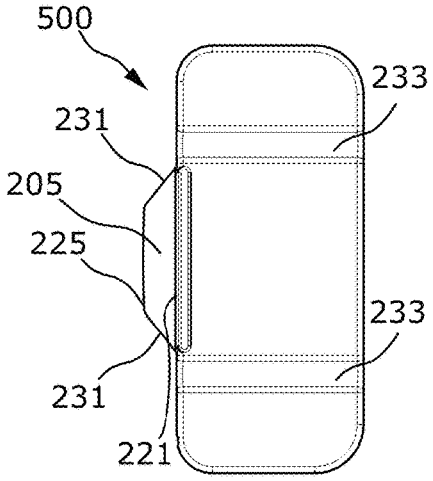
FIG. 13 is a front view of another embodiment of the male part.
Figure 14:
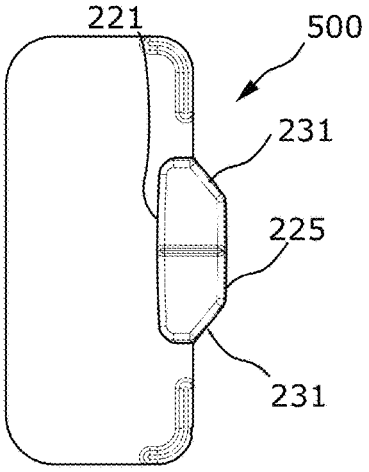
FIG. 14 is a rear view of the male part of FIG. 13.
Figure 15:
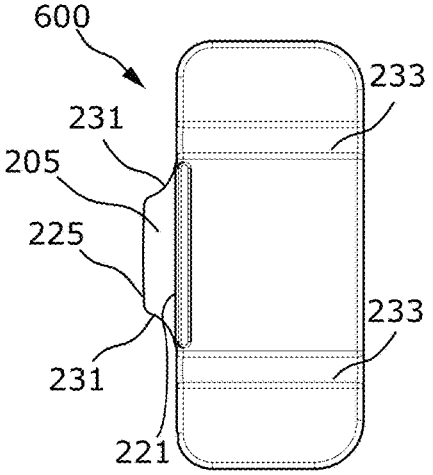
FIG. 15 is a front view of another embodiment of the male part.
Figure 16:
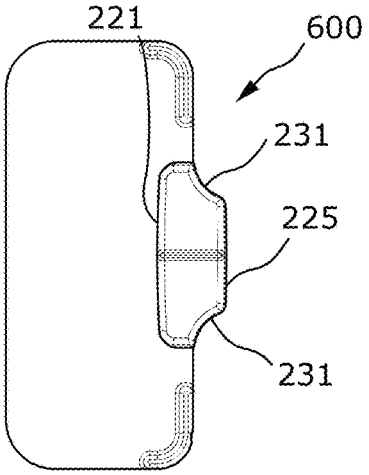
FIG. 16 is a rear view of the male part of FIG. 15.

FIGS. 13 & 14 show front and rear views, respectively, of another embodiment of the male part, indicated generally by the reference numeral 500; and FIGS. 15 & 16 show front and rear views, respectively, of yet another embodiment of the male part, indicated generally by the reference numeral 600. In each of male parts 500 & 600, foot 205 has a lateral width which decreases outwardly from a wider width at leg 221 to a narrower width at toe portion 225. In male part 500, sides 231 connecting the narrower to wider regions are substantially straight and angled inwardly. In male part 600, sides 231 are inwardly curved. Both of these configurations permit easier opening and closing of the fastener.

Figure 17:
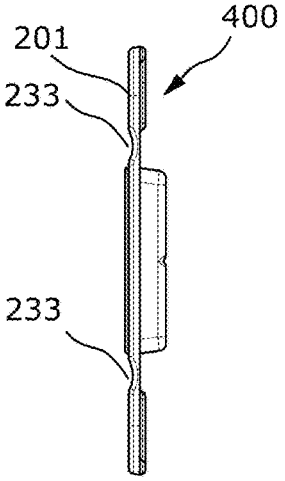
FIG. 17 is a right side view of the male part of FIG. 11.

FIG. 17 is a right side view of male part 400, the right side views of male parts 500 & 600 being identical. Male part 400 has two longitudinal channels 233 in body 201, positioned on opposing sides of foot 205. Channels 233 have a reduced thickness relative to other regions of body 201. The relatively thin structure in the regions of channels 233 provides a flexible region which bends resiliently under stress, thereby further facilitating the coupling and decoupling of the fastener. In addition, the flexibility of the male provides additional comfort to the wearer, especially when moving around.

Figure 18:
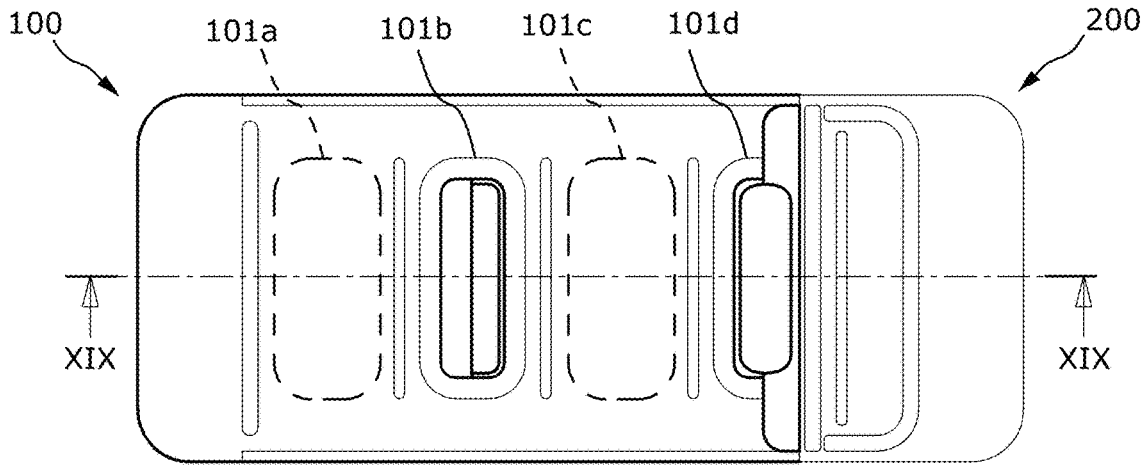
FIG. 18 is a front view of another embodiment of the female part engaged with the male part.
Figure 19:
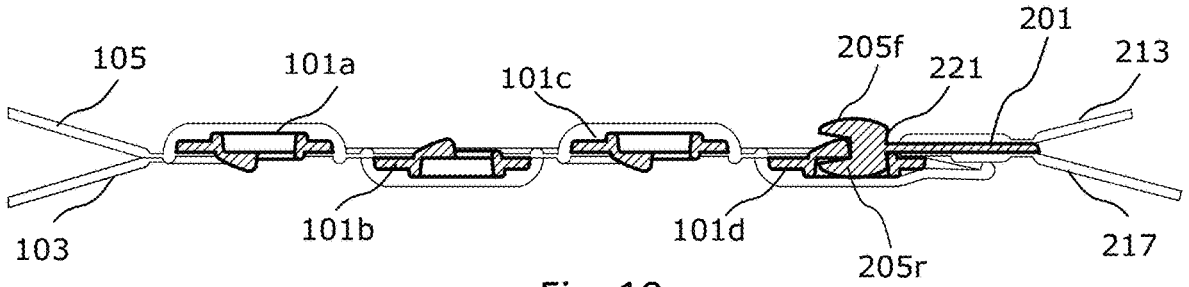
FIG. 19 is an enlarged cross-sectional view along line XIX-XIX of FIG. 18.
Figure 20:
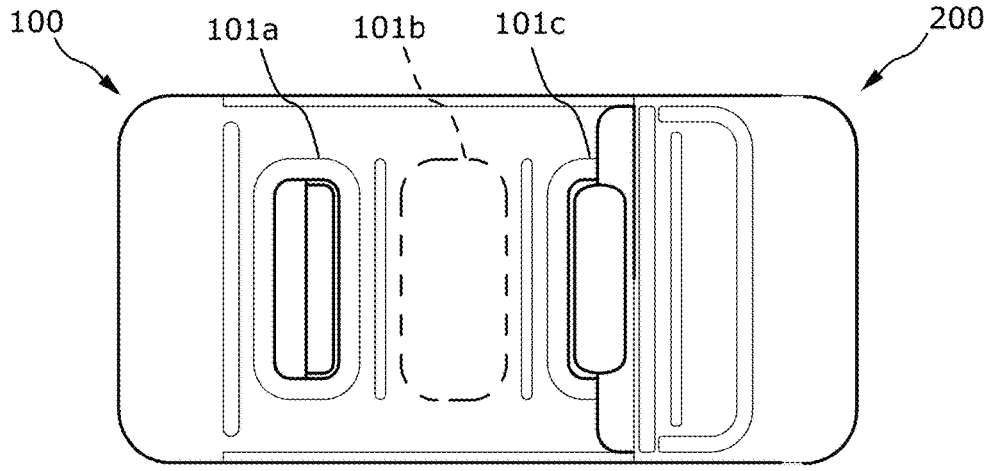
FIG. 20 is a view of the embodiment of FIG. 18 with the male part engaged on the reverse side of the female part.

FIGS. 18-20 illustrate an embodiment of the fastener for use with reversible garments, wherein when the garment is reversed the male part is still engagable with the side of the female part opposite the body of the wearer. FIG. 18 is a front view of such an embodiment, and FIG. 19 is an enlarged cross-sectional view along line XIX-XIX of FIG. 18. Four frames 101*a-d* are included in female part 100 and are mounted in a longitudinally spaced row. Frames 101*b* and 101*d* are mounted onto the face of fabric strip 103, as discussed in reference to FIG. 9. Frames 101*a* and 101*c* are mounted onto overlay 105 such that mouths 107*a* and 107*c* open to the rear of female part 100 (shown in hidden lines in the front view of FIG. 18). The frames mounted on fabric strip 103 are positioned alternately with frames mounted on overlay 105, such that the frames alternate between having forwardly and rearwardly open mouths.

In the shown embodiment, leg 221 of male part 200 depends both upwardly and downwardly from body 201. Leg 221 terminates in two feet 205*f* and 205*r*. Foot 205*r* is configured substantially as described in discussion of FIG. 7, and foot 205*f* is substantially a mirror image of 205*r* taken about the plane of body 201. This arrangement enables the male to engage the female from either the front or rear of the female.

FIG. 20 is a view of the embodiment of FIG. 18 with the male part engaged on the reverse side of the female part. In FIG. 18, foot 205*r* of the male is shown engaged with frame 101*d* of the female, while in FIG. 20 foot 205*f* is engaged with frame 101*c* of the female. Foot 205*r* may alternately be engaged with frame 101*b*, and, similarly, foot 205*f* may alternately be engaged with frame 101*a*.

Fabric strip 103 may be differently styled from overlay 105, such as in color, texture, pattern, or material. Upper component 213 of male part 200 may be of similar style to overlay 105, while lower component 217 may be styled like fabric strip 103. Frames which are visible from one side of the garment may be styled to coordinate with fabric visible on the same side (e.g. frames 101*a* & 101*c* may be color coordinated with fabric 103). The exposed side of male part 200 may be similarly coordinated. This configuration presents two differing yet cohesive appearances when the garment is worn in one orientation or in reverse (inside-out), thereby providing a reversible garment.

Figure 21:
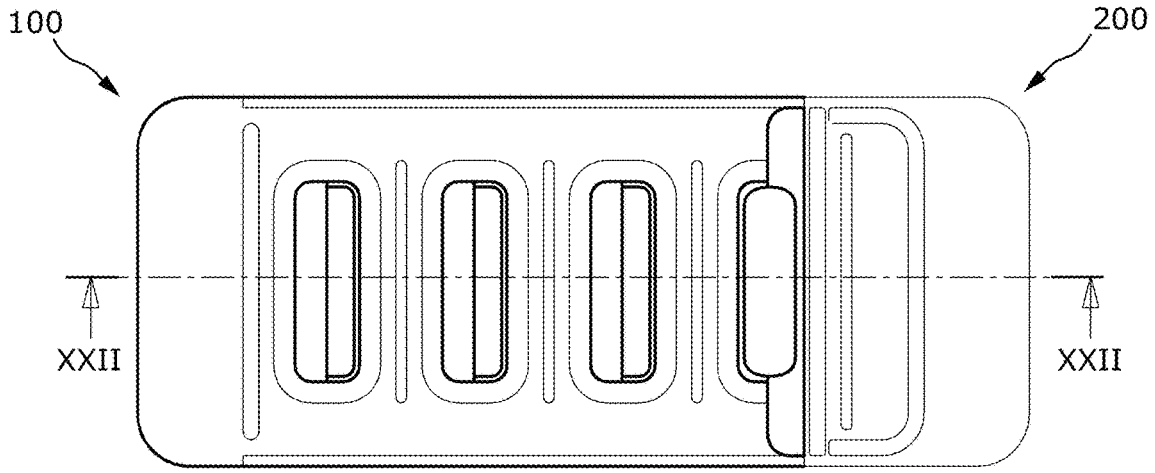
FIG. 21 is a front view of another embodiment of the female part engaged with the male part; and, FIG. 22 is an enlarged cross-sectional view along line XXII-XXII of FIG. 21.
Figure 22:
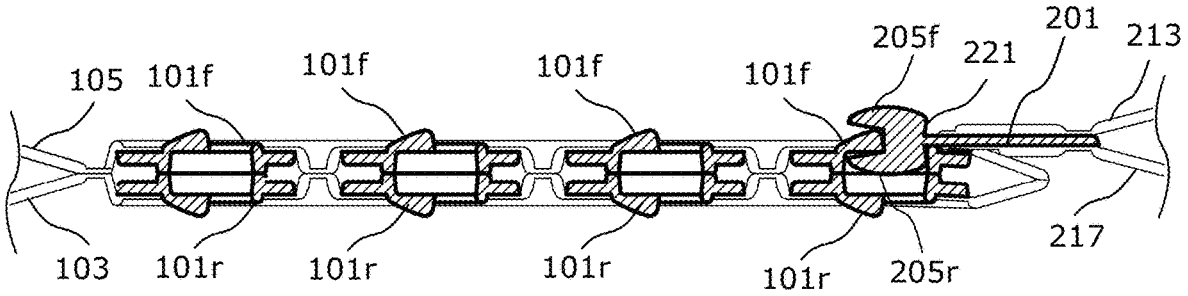

FIGS. 21 & 22 illustrate another embodiment of the fastener for use with reversible garments, FIG. 21 being a front view of female part 100 engaged with male part 200 and FIG. 22 being an enlarged cross-sectional view along line XXII-XXII of FIG. 21. Male part 200 includes two feet, 205*f* and 205*r*, configured as discussed above. Female part 100 includes eight frames, mounted in pairs in a longitudinally spaced row. Four frames, designated 101*r*, are mounted onto fabric strip 103 such that mouths 107*r* open to the rear. The other four frames, designated 101*f*, are mounted onto overlay 105 such that mouths 107*f* open to the front. Male foot 205*r* is engagable with any of frames 101*f*, as shown in FIG. 22. When the garment is reversed, male foot 205*f* is engagable with any of frames 101*r*. In the shown configuration of female part 100, each frame 101*f* is aligned with a frame 101*r*, such that rooves 121 are directly opposed on either side of the female part. Cavities 119 are aligned, and open mouths 107 which are not engaged with a foot of the male form a clear aperture through which skin may be visible when worn. Styles of the fabrics, female frames, and male bodies may be coordinated as discussed above to achieve two cohesive reversible appearances, from the front or rear.

It will be understood that various modifications could be made to the fastener according to the invention without departing from the spirit of the invention. For example, in the examples shown, there are shown three positions (i.e. frames 101) in the female member 100 for reception of the male part of the fastener. More or fewer frames 101 could be provided to provide a more or less adjustable fastener. It is envisaged however that the fastener as shown provides a degree of adjustability and is considered to be an adjustable fastener. It is further envisaged that the fastener could be used for shoulder straps and is not limited to a back or front fastener for a brassiere, for example. The fastener is preferably made out of plastic material. If desired, an additional layer of padding material could be provided for comfort. Although this will increase the depth of the fastener, for example the padding layer may be of the order of 0.0005 m thick or more leading to a fastener that could be of the order of 0.005 m thick or more, the padding may provide a more comfortable fastener for the wearer thereby improving the desirability of the fastener. An "ultra-slim" fastener will be understood to be a fastener having a thickness of the order of 0.005 m (5 mm) or less. In the drawings, some of the dimensions (in millimeters) of the embodiments of fastener are shown however these are not necessarily deemed limiting and other dimensions of fastener could be provided to good effect.

In order to manufacture a fastener according to the invention, the method comprises the steps of cutting out an aperture in an overlay sheet before bonding the overlay sheet to a fabric strip along at least one edge of both the overlay sheet and the fabric strip. The frame of the female part is then placed on the overlay sheet with the open mouth of the frame in alignment with the aperture in the overlay sheet. The frame of the female part is bonded to the overlay sheet. Once bonded, the fabric strip is drawn over the other side of the frame of the female part so that the bond line along the bonded edge of both the overlay sheet and the fabric strip is sandwiched between the overlay sheet and the fabric strip. Finally, the fabric strip is bonded to the other side of the frame, and the overlay sheet is bonded to the fabric strip along any remaining un-bonded edges. It is envisaged that in one implementation, the initial step of bonding the overlay sheet to the fabric strip along at least one edge of both the overlay sheet and the fabric strip will entail bonding the overlay sheet to the fabric strip along three edges of the overlay sheet and the fabric strip thereby forming a pouch. Thereafter, the step of drawing the fabric strip over the other side of the frame of the female part so that the bond line along the bonded edge is sandwiched between the overlay sheet and the fabric strip comprises turning the pouch inside out, thereby drawing the frame inside the pouch. This is seen as a particularly useful method of manufacturing the female part of the fastener. The male part is constructed by bonding the fabric to the substantially planar body. In all cases, ultrasonic welding is seen as a useful choice for bonding the components together.

In the specification the terms "comprise, comprises, comprised and comprising" and the terms "include, includes, included and including" are all deemed totally interchangeable and should be afforded the widest possible interpretation.

The embodiments of the fastener described herein and garments incorporating same are exemplary and numerous modifications, combinations, variations, and rearrangements can be readily envisioned to achieve an equivalent result, all of which are intended to be embraced within the scope of the appended claims. Further, nothing in the above-provided discussions of the fastener and construction method should be construed as limiting the invention to a particular embodiment or combination of embodiments. The scope of the invention is defined by the appended claims.

The invention claimed is:

1. An ultra-slim fastener for securing a first piece and a second piece of a garment together, the fastener comprising:

a male part configured to be mounted on the first piece and a female part configured to be mounted on the second piece;

the male part comprising a substantially planar body having an outermost body end, a downwardly depending leg disposed at the outermost body end and terminating in an outwardly projecting foot extending substantially parallel to the plane of the body;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting the inserted male part from an inclined orientation to a co-planar orientation with respect to the female part using the roof of the cavity as a fulcrum, and release of the foot from the cavity is realized by pivoting the inserted male part from the co-planar orientation back to the inclined orientation using the roof of the cavity as a fulcrum before moving the male part and the female part apart; and, a fabric strip and an overlay, the overlay having an aperture, the frame of the female part sandwiched between the fabric strip and the overlay such that the aperture corresponds with the open mouth, the fabric strip forms a backing for the frame, and the bottom of the cavity is closed off by the fabric strip.

2. The ultra-slim fastener of claim 1 in which the frame comprises an upstanding collar surrounding the open mouth.

3. The ultra-slim fastener of claim 2 in which a portion of the upstanding collar nearest the innermost frame end extends further upwardly from the frame than the remainder of the upstanding collar.

4. The ultra-slim fastener of claim 1 in which the cavity of the frame comprises a first downwardly depending flange adjacent the outermost frame end and a second downwardly depending flange, the second downwardly depending flange being positioned adjacent the innermost frame end and being dimensioned to protrude downwardly from the frame by the same distance as the first downwardly depending flange.

5. The ultra-slim fastener of claim 1 in which the cavity has a side wall adjacent the outermost frame end which slopes towards the outermost frame end from top to bottom, and the foot has a heel portion that slopes away from the outermost body end from top to bottom.

6. The ultra-slim fastener of claim 1 in which the substantially planar body has an upwardly extending flange adjacent the outermost body end.

7. The ultra-slim fastener of claim 1 in which the depth of the male part from the uppermost point on the male part to the lowermost point of the foot is no more than 0.0027 m deep.

8. The ultra-slim fastener of claim 1 in which the depth of the female part from the uppermost point on the frame to the lowermost point of the second piece connected to the frame is no more than 0.0034 m deep.

9. The ultra-slim fastener of claim 1 in which the foot of the male part has a lateral width which decreases outwardly from near the leg to a toe portion of the foot.

10. The ultra-slim fastener of claim 9 in which the foot has sides extending outwardly from the leg to the toe portion and wherein the sides are rounded, angled inwardly, or curved inwardly.

11. The ultra-slim fastener of claim 1 in which the body of the male part includes two longitudinal channels positioned on opposing sides of the foot.

12. An ultra-slim fastener for securing two ends of a garment together, the fastener comprising:

a first piece having a male part mounted thereon, the first piece configured for attachment to one of the ends of the garment;

a second piece comprising a fabric strip, an overlay, and at least one female part, at least one of the fabric strip and the overlay having an aperture, the second piece configured for attachment to other of the ends of the garment;

the male part comprising a substantially planar body having an outermost body end, a downwardly depending leg disposed at the outermost body end and terminating in an outwardly projecting foot extending substantially parallel to the plane of the body;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting the inserted male part from an inclined orientation to a co-planar orientation with respect to the female part using the roof of the cavity as a fulcrum, and release of the foot from the cavity is realized by pivoting the inserted male part from the co-planar orientation back to the inclined orientation using the roof of the cavity as a fulcrum before moving the male part and the female part apart;

the frame of the female part mounted to one of the fabric strip or the overlay, the frame being sandwiched between the fabric strip and the overlay, and location of the aperture corresponding with the open mouth;

a plurality of female parts arranged in a longitudinally spaced row, alternately mounted to the fabric strip and the overlay, and positioned so that mouths of each female part alternately open forwardly and rearwardly; and, the leg of the male part depending both upwardly and downwardly from the body and terminating in two legs opposed about the body.

13. The ultra-slim fastener of claim 12 in which the depth of the fastener from the uppermost point on the male part to the lowermost point of the second piece connected to the female part when the male part and the female part are engaged is no more than 0.0035 m deep.

14. The ultra-slim fastener of claim 12 in which the second piece comprises a laminate of tricot fabric and microfiber fabric, the first piece comprises a fabric strip, and the fabric strip of the first piece comprises at least one of tricot fabric and microfiber fabric.

15. An ultra-slim fastener for securing two ends of a garment together, the fastener comprising:

a first piece having a male part mounted thereon, the first piece configured for attachment to one of the ends of the garment;

a second piece comprising a fabric strip, an overlay, and at least one female part, at least one of the fabric strip and the overlay having an aperture, the second piece configured for attachment to other of the ends of the garment;

the male part comprising a substantially planar body having an outermost body end, a downwardly depending leg disposed at the outermost body end and terminating in an outwardly projecting foot extending substantially parallel to the plane of the body;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting the inserted male part from an inclined orientation to a co-planar orientation with respect to the female part using the roof of the cavity as a fulcrum, and release of the foot from the cavity is realized by pivoting the inserted male part from the co-planar orientation back to the inclined orientation using the roof of the cavity as a fulcrum before moving the male part and the female part apart;

the frame of the female part mounted to one of the fabric strip or the overlay, the frame being sandwiched between the fabric strip and the overlay, and location of the aperture corresponding with the open mouth;

a pair female parts, one of the female parts mounted to the fabric strip and the other of the female parts mounted to the overlay, the female parts positioned so that the cavities are aligned longitudinally and the mouth of one female part opens forwardly while the mouth of the other female part opens rearwardly; and, the leg of the male part depending both upwardly and downwardly from the body and terminating in two legs opposed about the body.

16. The ultra-slim fastener of claim 15 in which the depth of the fastener from the uppermost point on the male part to the lowermost point of the second piece connected to the female part when the male part and the female part are engaged is no more than 0.0035 m deep.

17. The ultra-slim fastener of claim 15 in which the second piece comprises a laminate of tricot fabric and microfiber fabric, the first piece comprises a fabric strip, and the fabric strip of the first piece comprises at least one of tricot fabric and microfiber fabric.

* * * * *